US006374448B2

(12) United States Patent
Seifert

(10) Patent No.: US 6,374,448 B2
(45) Date of Patent: Apr. 23, 2002

(54) TOOTHBRUSH

(75) Inventor: Armin Seifert, Neuwied (DE)

(73) Assignee: M+C Schiffer GmbH, Neustadt/Wied (DE)

( * ) Notice: Subject to any disclaimer, the term of this patent is extended or adjusted under 35 U.S.C. 154(b) by 0 days.

(21) Appl. No.: 09/832,816

(22) Filed: Apr. 12, 2001

Related U.S. Application Data

(63) Continuation of application No. PCT/EP99/07672, filed on Oct. 13, 1999.

(30) Foreign Application Priority Data

Oct. 13, 1998 (DE) ..... 298 18 046

(51) Int. Cl.[7] ..... A46B 9/10

(52) U.S. Cl. ..... 15/110; 15/167.1; 15/169; 15/176.4; 15/188; 601/141

(58) Field of Search ..... 15/110, 167.1, 15/169, 172, 176.1–176.6, 188, 201, 202, 184; 601/141

(56) References Cited

U.S. PATENT DOCUMENTS

| | | | | | |
|---|---|---|---|---|---|
| 2,865,039 | A | * | 12/1958 | Kaye et al. | 15/184 |
| 2,916,756 | A | * | 12/1959 | Peilet et al. | 15/184 |
| 3,059,259 | A | * | 10/1962 | Peilet et al. | 15/184 |
| 3,065,757 | A | * | 11/1962 | Peilet | 15/184 X |
| 3,108,305 | A | * | 10/1963 | Peilet | 15/169 |
| 3,110,918 | A | * | 11/1963 | Tate, Jr. | 15/167.1 |
| 3,795,024 | A | * | 3/1974 | Weihrauch | 15/169 |
| 3,803,663 | A | * | 4/1974 | Weihrauch | 15/169 |
| 4,001,910 | A | * | 1/1977 | Peilet | 15/184 |
| 4,162,554 | A | | 7/1979 | Peilet | 15/184 |
| 6,161,245 | A | * | 12/2000 | Weihrauch | 15/201 |

FOREIGN PATENT DOCUMENTS

| | | | |
|---|---|---|---|
| GB | 81 | * | 1/1886 |
| CH | 284041 | * | 11/1952 |
| DE | 1 160 822 | | 1/1964 |
| DE | 39 28 919 | | 3/1991 |
| DE | 4207968 | * | 9/1993 |
| DE | 4338930 | * | 6/1994 |
| FR | 1024292 | * | 1/1953 |
| WO | 92/19177 | | 11/1992 |

* cited by examiner

*Primary Examiner*—Mark Spisich
(74) *Attorney, Agent, or Firm*—Lawrence E. Laubscher, Sr.

(57) ABSTRACT

The present invention relates to a brush, in particular a toothbrush, comprising a brush body carrying cleaning elements and a perforated plate through which the cleaning elements are projecting. A brush which is improved in terms of hygiene is created by the present invention in that the cleaning elements are arranged on a bristle carrier which is in threaded engagement with the brush body, and that the perforated plate is rotatably held on the brush body. Furthermore, the present invention suggests a bristle insert as a replacement part for said brush.

20 Claims, 3 Drawing Sheets

TOOTHBRUSH

REFERENCE TO RELATED APPLICATION

This is a continuation application of PCT Application No. PCT/EP99/07672 filed Oct. 13, 1999, which is based on the German application No. 298 18 046.4 filed Oct. 13, 1998.

BACKGROUND OF THE INVENTION

1. Field of the Invention

This invention relates to a toothbrush including a handle part, and a brush head carrying cleaning elements that project through a perforated plate. A bristle carrier supports the cleaning elements and the perforated plate, said bristle carrier having a circumference upon which thread webs are formed.

2. Description of the Prior Art

A toothbrush of the above-mentioned type in which the cleaning elements are formed by bundles or tufts of bristles is, for example, known from U.S. Pat. Nos. 4,152,806 and 4,149,293. In this prior-art toothbrush the perforated plate is pivotably supported on the brush body. The distance between the perforated plate and the brush body is varied by the pivotal movement of the perforated plate. As a result, the free length of the ends of the bristle filaments at the use side, i.e. that part of the bristle filaments that projects over the perforated plate, is also changed, so that a change in the stiffness of the bristle filaments is effected by the pivotal movement of the perforated plate relative to the brush body. When the bristle filaments project over the perforated plate with a relatively large length, the stiffness and, as a consequence, the hardness of the brush are low; with a small length, the stiffness is high.

The German Patent No. DE-A-39 28 919 discloses a massage device comprising a pot-shaped basic body and a base member which is also pot-shaped and provided in the basic body in engagement therewith. The base member comprises recesses through which a multitude of massage elements that are formed as bristle tufts are projecting. The ends of the massage elements at the fastening side are received in a mount which is in threaded engagement with the basic body. The distance of the ends of the massage elements at the fastening side is changed relative to the base member by rotating the mount. The base member is received with its annular edge in a correspondingly formed, surrounding annular groove of the basic body and locked to the basic body.

The above-mentioned toothbrushes that are already known from the prior art have the drawback that they do not meet today's hygienic demands. A wedge-shaped slot in which bacteria and dirt may get stuck is formed between the toothbrush body and the end of the perforated plate at the fastening side. A gap in which dirt may get stuck is also formed in the area of the bristle filaments between the perforated plate and the brush body, so that the brush becomes unsightly after a certain period of use. Moreover, the above-mentioned toothbrushes have the drawback that the free length of all of the bristle filaments projecting through the perforated plate is not changed in a uniform manner due to the pivotal movement of the perforated plate. Rather, the bristle filaments that are more remote from the point of pivotal movement are subjected to a greater change in length than the bristle filaments arranged in the neighborhood of the point of pivotal movement. Depending on the pivotal movement of the perforated plate, this results in a gradient of stiffness within the toothbrush tufting formed by the bristle filaments. The stiffness of the bristle filaments cannot be adjusted in a predeterminable manner with the necessary accuracy in the prior-art brushes.

SUMMARY OF THE INVENTION

It is the object of the present invention to provide a toothbrush of adjustable stiffness that satisfies today's hygienic demands and is still attractive in appearance after a long period of use, and whose stiffness can be adjusted very accurately. It is also the object of the present invention to provide a bristle insert as a replacement and wear part for the toothbrush according to the invention.

According to a more specific object of the invention, the toothbrush includes a handle part, and a brush head carrying cleaning elements that project through a perforated plate. A bristle carrier supports the cleaning elements and the perforated plate, said bristle carrier having a circumference upon which thread webs are formed.

Thanks to the perforated plate which is rotatably held on the brush body, the brush body is closed relative to the ends of the bristle filaments at the fastening side. The filaments are held in a bristle carrier which is in threaded engagement with the brush body. For changing the stiffness the bristle carrier is rotated relative to the brush body so that the bristle carrier travels relative to the brush body according to the thread pitch in the axial direction of a hole which accommodates the bristle carrier. The perforated plate just follows the rotation of the bristle carrier, thereby effecting a change in the stiffness of the cleaning elements without creating an open gap between the perforated plate and the brush body where dirt may collect. Thanks to the threaded engagement the bristle carrier changes its position relative to the perforated plate altogether, so that all of the cleaning elements held on the bristle carrier are uniformly changed with respect to their length. Thus the stiffness of all of the cleaning elements projecting beyond the perforated plate, which cleaning elements are e.g. formed by bristle filaments, is identically changed as well. Moreover, the brush of the invention has the further advantage that the desired stiffness of the bristle filaments can be adjusted accurately by rotating the bristle carrier.

Under hygienic aspects it is preferred that the perforated plate ends flush with the upper side of the brush body. Thanks to this measure a smooth surface is created on the surface of the brush in the area of those bristles whose stiffness can be varied.

Preferably, the brush body has further provided thereon an annular groove in which the perforated plate is detachably and rotatably held. Preferably, the detachable connection between perforated plate and brush body is created by a lock type connection. The perforated plate can thus be removed from the brush body and the bristle carrier can be rotated out of the brush body to replace worn bristle filaments held on the bristle carrier. If all of the bristle filaments of the toothbrush are arranged on the one or several bristle carriers, the whole toothbrush need not be replaced upon wear of all of the bristle filaments, but it is only necessary to replace the bristle carrier carrying the bristle filaments and, preferably, the perforated plate through which the bristle filaments are projecting.

The bristle carrier is detachably connected to the brush body, preferably together with the perforated plate. Such a detachable unit creates a bristle insert which can be inserted into the brush body as a replacement part. The detachable connection between the perforated plate and the brush body is preferably established by a lock type connection which is designed such that the bristle carrier is pressed against the perforated plate by applying pressure to said carrier, and the perforated plate can be removed together with the bristle carrier from the brush body.

Preferably, at least two thread webs are provided on the bristle carrier and distributed over the circumference thereof, with guide grooves being provided for the thread webs between the perforated plate arid a thread formed on the brush body. With such a configuration only the thread webs must be brought into alignment with the corresponding grooves and the bristle carriers must then be pressed together with the perforated plate into the brush body, whereby the insertion of the bristle carrier is, in particular, simplified during replacement of a bristle carrier with worn bristle filaments together with the perforated plate.

Bristle carrier and perforated plate are preferably removed in a simplified way in that the respective insertion grooves are in alignment with the end of the thread turns for the threaded pins. Upon rotation of the bristle carrier in such a way that said carrier moves towards the perforated plate, the thread webs in an end position will impinge on a boundary surface formed on the brush body for the thread. This boundary surface is in alignment with a respective side surface of a guide groove, so that the thread webs in the end position come to rest in the insertion grooves and the bristle carrier in said end position can be removed from the brush body by a mere axial displacement towards the perforated plate.

According to a further preferred development of the present invention, a hardness scale is provided on the face of the bristle carrier that faces away from the bristle filaments, so that the user of the brush is enabled to adjust a desired stiffness of the bristle filaments in a predeterminable way.

For the adjustment of the stiffness the bristle carrier may be connected to a knurled ring which at least in part projects over the portion of the brush body which surrounds the bristle carrier. Under hygienic aspects, however, it is preferred that, instead of such a knurled ring on the face of the bristle carrier facing away from the bristle filaments, a grip portion is provided, for instance for the fingers of a user. For an easy handling, however, it is preferred that the grip portion is designed such that a bristle carrier tool can be brought into operative communication with the bristle carrier. Such a bristle carrier tool is preferably detachably connected to the brush body, so that the bristle carrier tool can be gripped any time. Moreover, the brush body is made longer by the detachable bristle carrier tool connected thereto, so that the brush can be handled more easily on the whole.

Furthermore, the present invention relates to a bristle insert for a toothbrush of the above-mentioned type, comprising a bristle carrier carrying cleaning elements, the circumferential surface of which has formed thereon thread webs, as well as a perforated plate through which the cleaning elements are projecting. Such a bristle insert is suited as a replacement part for the above-mentioned toothbrush, which may also be an electrically driven toothbrush. Preferred developments of the bristle insert are indicated in the dependent claims.

BRIEF DESCRIPTION OF THE DRAWING

Further features, details and advantages of the present invention will become apparent from the following description of an embodiment taken in conjunction with the attached drawing, in which.

DETAILED DESCRIPTION

Figure 1:
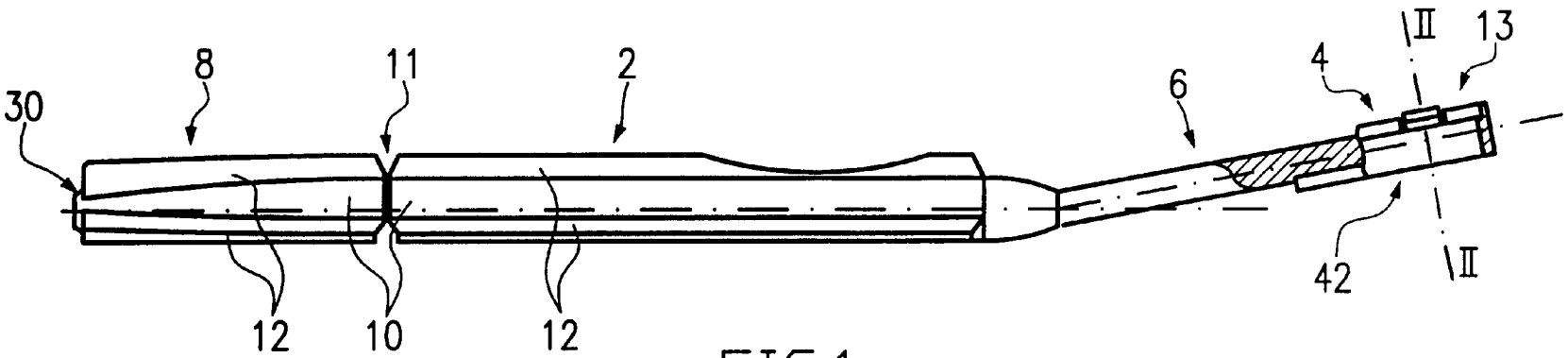
FIG. 1 is a partly sectional side view of an embodiment.

FIG. 1 is a partly sectional side view showing an embodiment of the present invention that is designed as a toothbrush. The toothbrush comprises a handle part 2 and a brush head 4, the two members having formed therebetween a tapered neck portion 6 which provides the elasticity required between handle part 2 and brush body 4 for preventing injuries of the oral mucosae that might be caused by the brush head 4 acting within the oral region. A bristle carrier tool 8 is arranged at the end of the handle part 2 that faces away from the brush head 4. Said bristle carrier tool 8 is connected to the handle part 2 via a lock type connection (not shown in more detail). The handle part 2 and the bristle carrier tool 8 are each provided with a cylindrical core 10 the circumference of which has arranged thereon in distributed fashion three ribs 12 extending in the longitudinal direction of the handle part 2. The diameter of the core 10 and the ribs 12 are made identical in the transitional portion between the handle part 2 and the bristle carrier tool 10. It is only in the area of ribs 12 that a notch 11 is provided by beveling the opposite, faces of the ribs, the notch signalizing the transition between handle part 2 and bristle carrier tool 8.

The ribs 12, on the one hand, and the core 10, on the other hand, are made from different components on the handle part 2 and on the bristle carrier tool 8, respectively, the ribs 12 being preferably made from a non-rigid plastic material. Alternatively, however, the ribs 12 may also be made from a more rigid material.

Figure 2:
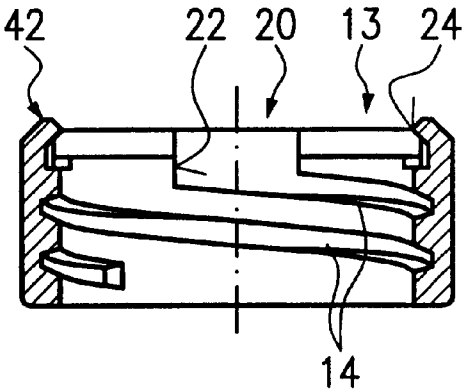
FIG. 2 is an enlarged sectional view taken along line II—II according to the illustration shown in FIG. 1.

The brush head 4 is formed by a substantially annular structural member which integrally joins the neck portion 6. A screw thread 14, which is shown in more detail in FIG. 2, is formed on the inner cylindrical surface of a recess 13 of the annular brush head 4. Insertion grooves 20 are formed between the screw thread 14 and the upper edge of the brush head 4 in accordance with the number of radially outwardly extending thread webs or projections 18 that are provided on a bristle carrier 16 shown in FIG. 3. A side surface 22 that laterally defines the insertion groove 20 forms a stop with respect to an upper turn of the thread 14.

The upper edge of the brush head 4 has formed thereunder an annular groove 24 the radius of which is smaller than the distance between the center point of the annular brush head 4 and the circumferential boundary surface of the insertion groove 20. A particularly compact design of the brush head 4 is created by this configuration.

Figure 3:
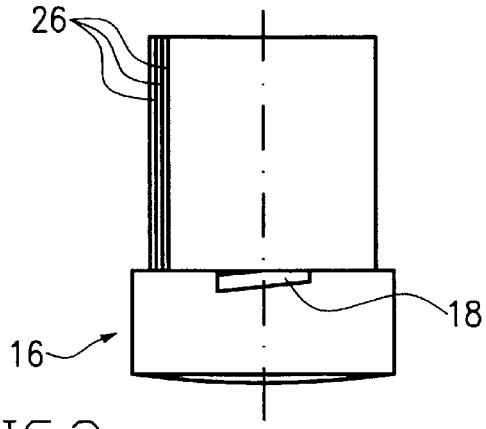
FIG. 3 is a side view of a bristle carrier for the, embodiment shown in FIG. 1.

The bristle carrier 16 shown in FIG. 3 is formed by a substantially cylindrical body on the circumference of which the thread webs 18 (here: two) are arranged in distributed fashion. A multitude of bristle filaments 26 which are combined to form bundles or tufts 25 of bristles project through the upper face of the bristle carrier 16 and are fastened thereto. The bristle filaments 26 may be fastened in the conventional way, i.e. by means of a metallic anchor. In the mounted state of the perforated disk, the bristle carrier 16 is then provided with bristles, i.e. the bristle filaments 26 are inserted through the perforated disk into the bristle carrier 16. Alternatively, the bristle filaments may be provided by over-molding bristle tuft ends when the bristle carrier 16 is manufactured in an injection molding process. In such a manufacturing process the perforated disk is preferably injection-molded together with the bristle carrier 16, with the mold cavity for the perforated disk being designed such that the individual bristle tufts to be connected to the bristle carrier 16 do not come into contact with plastic material.

Figure 4:
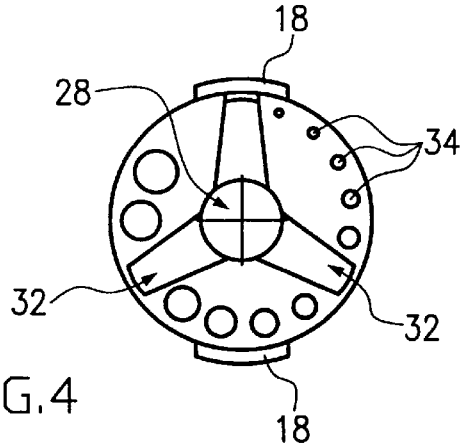
FIG. 4 is a top view on the bottom side of the bristle carrier according to the illustration shown in FIG. 3.

The face of the bristle carrier 16 that faces away from the bristle filaments 26 has a slightly convex curvature. As can be seen in FIG. 4, this surface has formed thereon a central hole 28 into which a pin 30 formed on the bristle carrier tool 8 can be inserted with a cylindrical cross-sectional surface. The hole 28 acts together with the pin 30 as a centering means for the bristle carrier tool 8. The face of the bristle carrier 16 that faces away from the bristle filaments 26 has formed thereon three recesses 32 that are arranged in distributed fashion on the circumference and extend in radial direction from the hole 28. The recesses 32 are configured such that they are cut into the convex surface of the bristle carrier 16 and the ribs 12 of the bristle carrier tool 8 can be introduced in a positive manner into the recesses 32. Finally, the face of the bristle carrier 16 that faces away from the bristle filaments 26 has mounted thereon a hardness scale 34 which is formed by optically distinguishable dots arranged on the edge portion of the circular face. This hardness scale can be read with the help of a reading web 36 which is formed on the bottom side of the brush head 4 and differs in color from the material of the neck portion 6.

Figure 5:
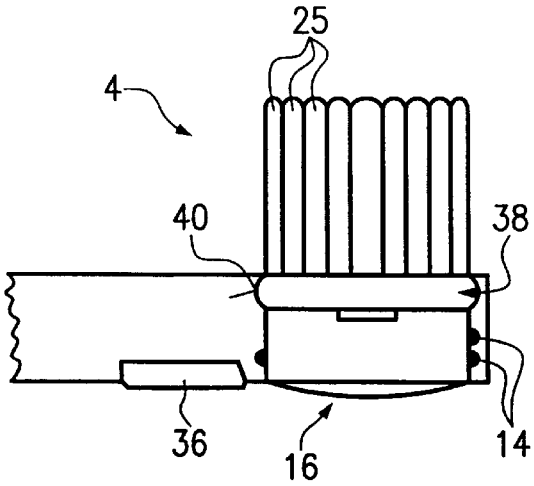
FIG. 5 is a partly sectional illustration of the brush head of the toothbrush shown in FIG. 1, in a first position of the bristle carrier.
Figure 6:
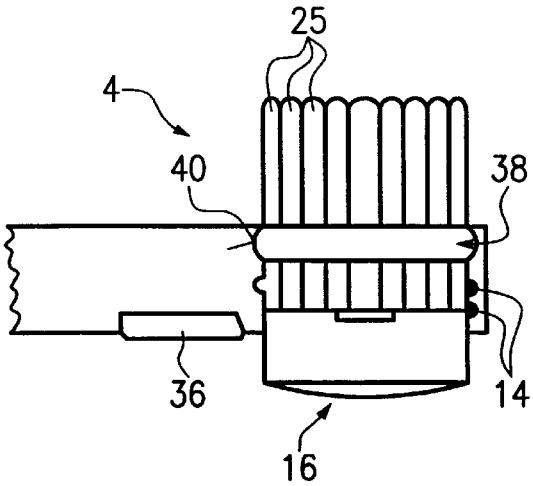
FIG. 6 shows the brush head illustrated in FIG. 5, in a second position of the bristle carrier.

A bristle insert which can be inserted as a wear part into the recess 13 formed on the brush head 4 consists of the bristle carrier 16 and of a perforated plate 38 shown in FIGS. 5 and 6, which is penetrated by the bristle filaments 26 that are combined to form bristle tufts 25. The perforated plate 38 is designed as a circular disk, with holes being provided on the perforated plate 38 to correspond to the position of the respective bristle tufts 25. The diameter of said holes corresponds to the thickness of the respective bristle tuft 25 projecting through the corresponding hole. In the illustrated embodiment bristle tufts 25 of an identical diameter are used. However, it is also possible to fasten bristle tufts 25 of a different thickness and geometrical design to the bristle carrier 16. In such a case the geometrical design of the holes of the perforated plate 38 corresponds to the boundary of the respective receiving means for the corresponding bristle tufts 25 in the bristle carrier 16.

For inserting the bristle insert into the recess 13 the radially outwardly extending thread webs 18 are first brought into alignment with the respective insertion grooves 20. Thereupon the bristle carrier 16 is axially pressed into the recess 13 together with a perforated plate 38 which is penetrated by the bristle tuft 25 and which rests on the upper side of the bristle carrier 16. A surrounding bead 40 of the annular groove 24 which is convexly formed on the side surface of the perforated plate 38 thereby presses associated locking noses 42 (FIG. 2) radially outwards, with the locking noses 42 covering the annular groove on the upper side. The axial advance movement of the bristle carrier 16 together with the perforated hole 28 will be stopped when the thread webs 18 impinge on the lower edge of the upper thread turn and when the perforated plate 38 is received in the annular groove 24 and gripped from behind by the locking noses 42. In this end position the perforated plate 38 rests on the upper face of the bristle carrier 16 so that the bristle filaments 26 project over the perforated plate 38 at a maximum length of use.

For changing the stiffness of the tufting formed by the bristle filaments 26 the bristle carrier tool 8 is removed in the illustrated embodiment in axial direction from the handle part 2. The pin 30 is introduced into the hole 28 and the ribs 12 are introduced into the recesses 32 by rotating the bristle carrier tool 8 centered in this way on the bristle carrier 16. The bristle carrier 16 is now rotated counterclockwise by operating the bristle carrier tool 8, so that the bristle carrier 16 travels according to the pitch of the thread 14 in axial direction along the recess 13. The perforated plate 38 which is rotatably supported in the annular groove 24 follows this rotation of the bristle carrier 16. The rotation of the bristle carrier 16 has the effect that the bristle carrier 16 is removed from the perforated plate 38. The ends of the bristle filaments 26 at the fastening side move in the same manner away from the perforated plate 38, whereby the free length of the bristle filaments 26 projecting over the perforated plate 38 to the outside is reduced, and the stiffness of the tufting increases.

The desired stiffness can be set via the angular position of the hardness scale indicia 34 and the reading web projection 36 in an exactly predeterminable way. The engagement of the bristle carrier tool 8 permits an adjustment of the stiffness of the toothbrush that can easily be handled. In the illustrated embodiment any desired and medically reasonable stiffness of the tufting of the toothbrush can be adjusted.

In the embodiment shown in the drawings all of the bristle filaments 26 are arranged on the bristle carrier 16. This has the advantage that worn bristle filaments 26 can be exchanged by replacing the bristle carrier 16. The component formed from the handle part 2, the brush head 4, the neck portion 6 and the bristle carrier tool 8 can be further used, i.e., irrespective of the worn state of the bristle filaments 26. To remove the bristle carrier 16, said carrier must be rotated clockwise until the thread webs 18 impinge on the side surface 22 of the insertion grooves 20. With his thumb a user can apply a force of pressure to the face of the bristle carrier 16 facing away from the bristle filaments 26 to undo the locking of the perforated plate 38 by the locking noses 42 and to press the bristle carrier 16 together with the perforated plate 38 out of the recess 13. A new bristle carrier with unused bristle filaments is inserted in the above-described manner.

Figure 7:
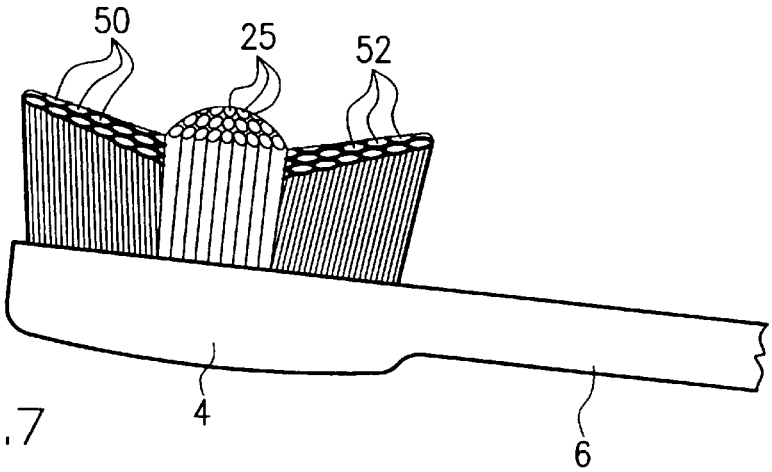
FIG. 7 is a side view showing part of a further embodiment.
Figure 8:
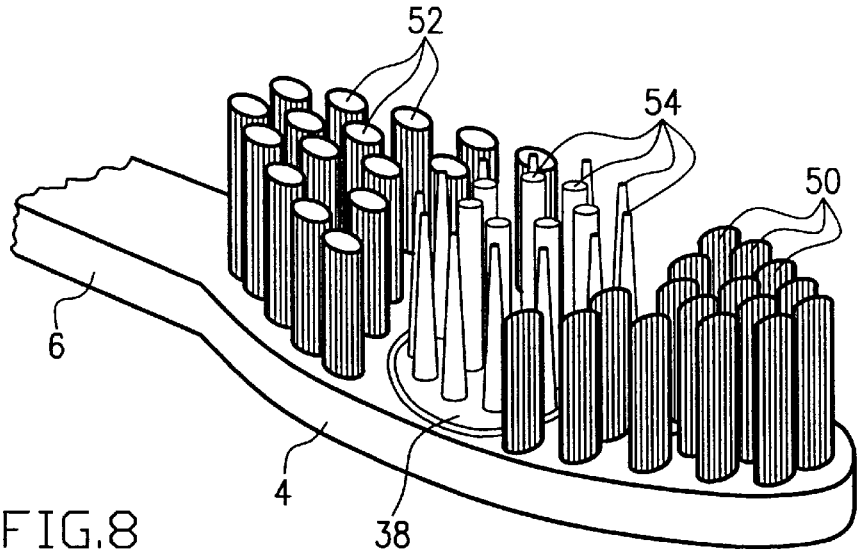
FIG. 8 is a perspective view of a third embodiment.

FIGS. 7 and 8 show two further embodiments in which in accordance with the above-explained embodiment a bristle carrier 16 is held in threaded engagement on a brush head 4. Further bristle tufts 50 that are fastened to the brush head 4 in a manner known per se, and whose stiffness is not adjustable, are provided in the longitudinal direction of the toothbrush in front of and behind the bristle carrier 16.

As can be seen in FIG. 7, the bristle tufts 52 next to the neck portion 6 are cut to length in this embodiment in the longitudinal direction such that the tufted surface comprising the ends of the bristle tufts 52 at the use side is inclined forwards whereas the bristle filaments forming the front bristle tufts 50 are cut to length such that the tufted surface comprising the ends of said bristle tufts 50 at the use side is inclined rearwards, i.e. towards the neck position 6. The bristle tufts 25 arranged on the bristle carrier 16 are spherically cut. In the end position of the bristle carrier 16 which is shown in FIG. 7 and in which the bristle tufts 25 project over the perforated plate to a maximum degree, the bristle tufts 50, 52 which are arranged next to the bristle tufts 25 and are not adjustable with respect to their hardness are provided at a lower level than the adjustable bristle tufts 25. The bristle filaments of the bristle tufts 50, 52 may be made from a material differing from that of the bristle filaments of the bristle tufts 25 and may in particular differ therefrom in their hardness. When the adjustable bristle tufts 25 are made longer by rotating the bristle carrier 16, the effect of said bristle tufts 25 is enhanced during the cleaning action; when the bristle tufts 25 are shortened, the cleaning characteristics of the bristle tufts 50, 52 are prevailing. Thus it is possible to vary not only the stiffness of the toothbrush, but also the cleaning characteristics of the brush on the whole by rotating the bristle carrier 16.

FIG. 8 shows a further embodiment of the present invention. In this embodiment the cleaning elements which are secured to the bristle carrier are not formed by bristle tufts, but by flexible rod-like massage elements 54 which in the instant case consist of a thermoplastic elastomer (TPE). In this instance, too, the free length of the rod-like massage elements 54 and thus the stiffness thereof can be varied as in the case of the above-described embodiments by rotating the bristle carrier 16 relative to the brush head 4. By analogy with the embodiment shown in FIG. 7, bristle tufts 50, 52 which cannot be adjusted with respect to their length and thus hardness are provided in front of and behind the massage elements 54. Apart from the stiffness of the massage elements 54, the position of the ends of the rod-like massage elements 54 at the side of use relative to the ends of the bristle tufts 50, 52 at the side of use and thus the cleaning characteristics of the brush on the whole are varied by rotating the bristle carrier 16. When the rod-like massage elements 54 are relatively short the effect of the bristle tufts 50, 52 prevails; when the rod-like massage elements 54 are relatively long, they will first contact the teeth to be cleaned and the gum, respectively, thereby exerting a predominant influence on the cleaning characteristics of the toothbrush.

Figure 9:
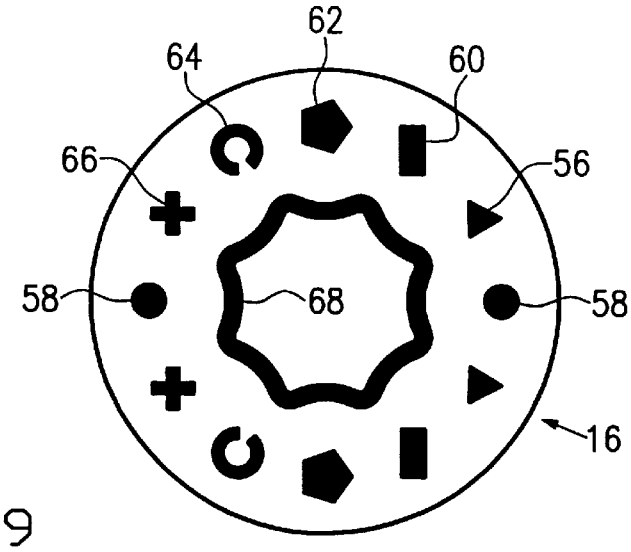
FIG. 9 is a top view on a bristle carrier with exemplary cross-sections of the tufts.

FIG. 9 shows various cross-sections of cleaning elements that may be formed either by bristle tufts or by TPE bristles. The bristle carrier 16 may be provided, optionally or in combination, with cleaning elements of a closed cross-sectional profile which may be triangular (reference numeral 56), round (reference numeral 58), square or rectangular (reference numeral 60) or polygonal (reference numeral 62). Moreover, the cross-section may be substantially C-shaped. Reference numeral 64 refers to such an open profile of a cleaning element. Likewise, it is possible to make the cross-sectional profile of the cleaning elements its star-shaped or cruciform (reference numeral 66). Finally, the cleaning element may have the cross-sectional geometry of a closed hollow profile (reference numeral 68). The illustrated hollow profile has an irregularly shaped circumferential surface, with the wall thickness being relatively small in comparison with the diameter of the hollow profile. Such open cross-sectional shapes are particularly suited for forming a hollow rod-shaped massage element.

The present invention is not limited to the illustrated embodiments. Of course, it is possible to provide a plurality of bristle carriers which have assigned thereto perforated plates rotatably supported on the brush body, whereby different hardness ranges of the tufting of a toothbrush can be set. Moreover, it should be noted that instead of the thread webs formed on the bristle carrier it is possible to realize any desired type of thread-like engagement between bristle carrier and brush body. In the embodiment shown in the drawing the recess 13 provided on the brush head 4 is encapsulated by the perforated plate 38 on the one hand and by the bottom side or the circumferential surface of the bristle carrier 16 on the other hand to minimize the penetration of dirt and impurities into the recess 13. In addition, one or several outwardly opening flushing openings may be provided on the brush body, the flushing openings communicating with the gap formed between the brush body 2, 4, 6 and the bristle carder 16. Dirt which has been introduced between the bristle carrier 16 and the perforated plate 38 into the recess 13 can be flushed out through such flushing openings.

What is claimed is:

1. A toothbrush comprising:

(a) a brush body (2, 4, 6) including an elongated handle part (2) having a longitudinal dimension extending between a pair of ends;

(b) a brush head (4) connected to one end of said handle part and having an upper surface and a lower surface, said brush head (4) supporting a plurality of longitudinal cleaning elements (26, 54) projecting from said upper surface in a direction substantially perpendicular to the longitudinal dimension of said elongated handle part (2);

(c) a bristle carrier (16) supporting said cleaning elements (26; 54) and being threadably mounted within a recess (13) formed in said brush head (4), said recess (13) being open to said lower surface of said brush head (4) opposite said upper surface; and (d) a perforated plate (38) through which said cleaning elements (26; 54) extend to project from said upper surface, said perforated plate (38) being rotatably supported on said brush head (4) to permit rotation of said bristle carrier relative to said brush body, said perforated plate ending flush with the upper surface of said brush head (4).

2. The toothbrush according to claim 1, characterized in that said brush body (2, 4, 6) has provided thereon an annular groove (24) in which said perforated plate (38) is detachably and rotatably held.

3. By The toothbrush according to claim 2, characterized in that said perforated plate (38) is locked onto said brush body (4).

4. The toothbrush according to claim 1, characterized in that said bristle carrier (16) together with said perforated plate (38) is detachably connected to said brush body (4).

5. The toothbrush according to claim 1, characterized in that said bristle carrier (16) comprises at least two thread webs (18) distributed over the circumference thereof, and that insertion grooves (20) are provided for said thread webs (18) between said perforated plate (38) and a thread (14) formed on said brush body (2, 4, 6).

6. The toothbrush according to claim 5, characterized in that the respective insertion grooves (20) are in alignment with the end of the thread turns for said thread webs (18).

7. The toothbrush according to claim 1, characterized in that indicia defining a hardness scale (34) is provided on the face of said bristle carrier (16) that faces away from the cleaning elements (26).

8. The toothbrush according to claim 1, and further including a bristle carrier tool (8) detachably connected to said brush body (2, 4, 6).

9. The toothbrush according to claim 8, wherein said bristle carrier (16) has on a face on the side thereof remote from said cleaning elements at least one engagement portion (28, 32) for receiving a corresponding operating end portion of said bristle carrier tool.

10. A toothbrush according to claim 9, characterized in that a centering means (28) for said bristle carrier tool (8) is provided on the face of said bristle carrier (16) that faces away from said cleaning elements (26; 54).

11. The toothbrush according to claim 8, wherein the face of said bristle carrier (16) that faces away from said cleaning elements (26) contains a centering means (28) for engagement by a corresponding end portion of said bristle carrier tool.

12. The toothbrush according to claim 8, characterized in that said bristle carrier tool (8) is connectable by means of a plug-type connection to said brush body (2).

13. The toothbrush according to claim 1, characterized in that said brush body (4) has provided thereon at least one outwardly opening flushing opening which communicates with a gap formed between said brush body (4) and said bristle carrier (16).

14. The toothbrush according to claim 1, characterized in that a cleaning element is formed by a non-rigid rod-shape massage element (54).

15. The toothbrush according to claim 1, and further including bristle tuft cleaning elements mounted on said brush body.

16. The toothbrush according to claim 1, characterized in that said perforated plate (38) comprises at least one locking edge.

17. The toothbrush according to claim 16, characterized in that said locking edge is formed by an annular bead (40) formed on the circumferential surface of said perforated plate (38).

18. The toothbrush according to claim 16, wherein said bristle carrier (16) includes a face remote from said cleaning elements (26; 54) that contains engagement means (28, 32) operably engageable by a bristle carrier tool (8).

19. A toothbrush according to claim 1, characterized in that at least one cleaning element is formed by a non-rigid rod-shape massage element (54).

20. A toothbrush according to claim 19, characterized in that said rod-shaped massage element (54) is made from TPE.

* * * * *